US012326087B1

(12) United States Patent
Shi et al.

(10) Patent No.: US 12,326,087 B1
(45) Date of Patent: Jun. 10, 2025

(54) FIRE-PREVENTION AND EXTINGUISHING MATERIAL FOR PLUGGING AIR LEAKAGE IN UNDERGROUND BARRIER PILLAR OF COAL MINE AND USE METHOD THEREOF

(71) Applicant: CHINA UNIVERSITY OF MINING AND TECHNOLOGY, Jiangsu (CN)

(72) Inventors: Quanlin Shi, Jiangsu (CN); Botao Qin, Jiangsu (CN); Xu Shao, Jiangsu (CN); Mingyue Hao, Jiangsu (CN); Zujie Ma, Jiangsu (CN); Gang Han, Jiangsu (CN); Jiahao Xie, Jiangsu (CN); Hu Liu, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 18/977,743

(22) Filed: Dec. 11, 2024

(30) Foreign Application Priority Data

Jan. 25, 2024 (CN) ..... 202410104727.8

(51) Int. Cl.
*E21F 5/08* (2006.01)

(52) U.S. Cl.
CPC ..... *E21F 5/08* (2013.01)

(58) Field of Classification Search
CPC . E21F 5/08; A62C 3/02; A62C 3/0221; A62C 3/04
USPC ..... 169/45, 65, 48, 49; 299/12; 454/169
See application file for complete search history.

(56) References Cited

U.S. PATENT DOCUMENTS

2023/0228085 A1* 7/2023 Blackburn ..... B28B 23/0006 442/42

FOREIGN PATENT DOCUMENTS

| | | | | | |
|---|---|---|---|---|---|
| CN | 205476243 U | * | 8/2016 | ..... | Y02W 30/91 |
| CN | 106986597 | | 7/2017 | | |
| CN | 116624186 A | * | 8/2023 | ..... | E21D 11/105 |
| CN | 116639944 A | * | 8/2023 | ..... | C04B 28/14 |
| CN | 116675492 A | * | 9/2023 | ..... | E21F 5/08 |
| KR | 20230049603 A | * | 4/2023 | ..... | B25J 19/023 |

* cited by examiner

*Primary Examiner* — Steven M Cernoch
(74) *Attorney, Agent, or Firm* — JCIPRNET

(57) ABSTRACT

The present disclosure provides a fire-prevention and extinguishing material for plugging an air leakage in an underground barrier pillar of a coal mine and a use method thereof. The fire-prevention and extinguishing material for plugging the air leakage includes an upper fabric layer, an intermediate layer, and a lower fabric layer. A plurality of fiber filaments are evenly distributed in the intermediate layer such that the intermediate layer has a flexible deformability. The intermediate layer is filled with a cement powder. The upper fabric layer is made of a flame-retardant flexible material. The upper fabric layer is configured to deform under a pressure to block off oxygen and plug the air leakage in the underground barrier pillar. The lower fabric layer is made of a water-soluble material.

5 Claims, 1 Drawing Sheet

FIRE-PREVENTION AND EXTINGUISHING MATERIAL FOR PLUGGING AIR LEAKAGE IN UNDERGROUND BARRIER PILLAR OF COAL MINE AND USE METHOD THEREOF

CROSS-REFERENCE TO RELATED APPLICATION

This application claims the priority benefit of China application serial no. 202410104727.8, filed on Jan. 25, 2024. The entirety of the above-mentioned patent application is hereby incorporated by reference herein and made a part of this specification.

TECHNICAL FIELD

The present disclosure relates to the technical field of fire prevention and extinguishing by plugging air leakage, and in particular to a fire-prevention and extinguishing material for plugging an air leakage in an underground barrier pillar of a coal mine and a use method thereof.

BACKGROUND

Coal is the main energy source in China. However, the coal mining is faced with serious threats from disasters such as spontaneous combustion of coal in goafs, which result in direct and indirect economic losses to mines up to tens of billions of yuan every year, and are also prone to cause major coal mine fires and gas explosion accidents. In addition, the disasters such as spontaneous combustion of coal in goafs may cause the serious resource burning, the environmental pollution, and the destruction of vegetation, soil, groundwater, or the like.

The spontaneous combustion of coal in an underground goaf of a coal mine is mainly caused by air leakage. Barrier pillars which play an isolation role in the underground goaf of the coal mine are subjected to a pressure from an overlying rock formation, and have different widths at different locations. As a result, some barrier pillars are easily fractured, resulting in the complete development of fractures inside these barrier pillars (that is, the fractures allow the goaf to be in communication with a roadway). During the underground production work, the pressure difference is produced between the roadway and the adjacent goaf. In this case, the fractures generated in the barrier pillars which allow the goaf to be in communication with the roadway will form air leakage paths, such that the air in the roadway enters the goaf and thus the air leakage occurs. Therefore, the oxygen concentration in the goaf increases, which may lead to the oxidative spontaneous combustion of the residual coal or the fractured barrier pillars in the goaf, so that the probability of spontaneous combustion of coal greatly increases.

Currently, air leakage paths formed by fractures in barrier pillars are generally prevented and controlled by a plugging technology to control or reduce the air leakage, thereby reducing the oxygen content to prevent the spontaneous combustion of coal. Materials for plugging air-leakage fractures in barrier pillars of coal mines mainly include the conventional grouting materials such as yellow mud and cement, paste filling materials, rigid polyurethane foam-based spray filling materials, and novel materials such as Rocsil, Marithan, and expanding cement. The inorganic curing materials have poor deformation resistance, and are likely to cause air leakage again, and exhibit a poor continuous plugging effect. The organic foam materials have prominent filling and plugging effects and excellent dynamic compression resistance. However, the organic foam materials have high costs, and are prone to decompose at elevated temperatures to release toxic and harmful gases. CN106986597A discloses a retardant slurry material for plugging air leakage in underground mines. However, the retardant slurry material has a relatively low compressive strength after being solidified and formed, and is easily fractured under an action of a mine pressure or a mine earthquake, resulting in air leakage again in fractures of barrier pillars and a poor continuous effect in plugging air leakage.

Therefore, in view of the problem that the existing materials for plugging air leakage have a relatively low compressive strength, it is one of the research directions in the art to provide a novel fire-prevention and extinguishing material for plugging air leakage and a use method thereof, where the novel fire-prevention and extinguishing material for plugging air leakage can quickly plug fractures generated in a barrier pillar and can still completely cover the air-leakage fractures in the barrier pillar after being subjected to a mine pressure, a mine earthquake, or the like subsequently to achieve excellent effects in plugging air leakage and isolating oxygen, so as to finally achieve the long-term fire prevention and extinguishing by plugging air leakage in a goaf.

SUMMARY

In view of the above-mentioned problems in the prior art, the present disclosure provides a fire-prevention and extinguishing material for plugging an air leakage in an underground barrier pillar of a coal mine and a use method thereof. The fire-prevention and extinguishing material for plugging the air leakage can quickly plug fractures generated in a barrier pillar, and can still completely cover the air-leakage fractures in the barrier pillar after being subjected to a mine pressure, a mine earthquake, or the like subsequently to achieve excellent effects in plugging air leakage and isolating oxygen, so as to finally achieve the long-term fire prevention and extinguishing by plugging air leakage in a goaf.

To achieve the above objective, the present disclosure adopts the following technical solutions. A fire-prevention and extinguishing material for plugging an air leakage in an underground barrier pillar of a coal mine is provided. The fire-prevention and extinguishing material for plugging the air leakage has a layered structure and includes an upper fabric layer, an intermediate layer, and a lower fabric layer;

the intermediate layer is arranged between the upper fabric layer and the lower fabric layer; a plurality of fiber filaments are evenly distributed in the intermediate layer, and two ends of each of the plurality of fiber filaments are connected to the upper fabric layer and the lower fabric layer, respectively, such that the intermediate layer has a flexible deformability; the intermediate layer is filled with a cement powder such that the cement powder is evenly distributed around the plurality of fiber filaments;

the upper fabric layer is made of a flame-retardant flexible material, and the upper fabric layer is configured to deform under a pressure to block off oxygen and plug the air leakage in the underground barrier pillar; and the lower fabric layer is made of a water-soluble material, and when in contact with water, the lower fabric layer is dissolved such that the cement powder in the intermediate layer is mixed with the water to produce a cement slurry and the cement slurry is filled into fractures of the underground barrier pillar and solidified to plug the air leakage in the underground barrier pillar.

Further, the upper fabric layer is made of one selected from the group consisting of aramid 1313, a polyphenylene sulfide fiber, a phenolic fiber, a melamine fiber, and a polyimide fiber, or a mixture of two or more thereof.

Further, the lower fabric layer is made of a water-soluble polyvinyl alcohol fiber. The water-soluble polyvinyl alcohol fiber has an excellent performance, which can ensure that the water-soluble polyvinyl alcohol fiber can be quickly dissolved after encountering water.

Further, the plurality of fiber filaments are nylon fiber filaments. The nylon fiber filaments have a high deformability and toughness, such that the possibility of fracturing of the plurality of fiber filaments deformed under a pressure is reduced, which achieves a plugging effect after being deformed under the pressure.

Further, the cement powder is a rapid-hardening cement powder. When this material is used, the cement slurry can be quickly solidified after flowing to the surface of the underground barrier pillar and flowing into fractures of the underground barrier pillar, which can achieve a rapid plugging effect and effectively shorten a plugging time.

A preparation method of the fire-prevention and extinguishing material for plugging the air leakage in the underground barrier pillar of the coal mine is provided, specifically including: selecting respective materials as needed, and weaving the materials into the upper fabric layer, the intermediate layer, and the lower fabric layer by a textile technology; evenly distributing the plurality of fiber filaments in the intermediate layer; filling the intermediate layer with the cement powder such that the cement powder is evenly distributed around the plurality of fiber filaments; and sealing the intermediate layer to obtain the fire-prevention and extinguishing material for plugging the air leakage in the underground barrier pillar of the coal mine.

A use method of the fire-prevention and extinguishing material for plugging the air leakage in the underground barrier pillar of the coal mine is provided, including the following steps:

step 1, fixing the fire-prevention and extinguishing material for plugging the air leakage to a roadway roof: in a roadway, laying the fire-prevention and extinguishing material for plugging the air leakage from top to bottom along a surface of the underground barrier pillar with the air leakage, and arranging a top anchor rod at a top of the fire-prevention and extinguishing material for plugging the air leakage to fix the fire-prevention and extinguishing material for plugging the air leakage to the roadway roof, where the lower fabric layer faces towards the surface of the underground barrier pillar;

step 2, fixing the fire-prevention and extinguishing material for plugging the air leakage to the underground barrier pillar: at two sides of the fire-prevention and extinguishing material for plugging the air leakage, arranging fixing anchor rods at intervals of 1.5 m to 2 m from the roadway roof downwards, such that the fire-prevention and extinguishing material for plugging the air leakage is fixed to and pressed against the underground barrier pillar and the lower fabric layer is closely attached to the surface of the underground barrier pillar;

step 3, spraying water for plugging the air leakage: spraying water with an underground water pipe evenly to the upper fabric layer of the fire-prevention and extinguishing material for plugging the air leakage, the water entering the intermediate layer through the upper fabric layer and mixing with the cement powder to produce the cement slurry, and continuing spraying water, the water coming in contact with the lower fabric layer to dissolve the lower fabric layer, and then the cement slurry in the intermediate layer flowing from the dissolved lower fabric layer to the surface of the underground barrier pillar, flowing into the fractures of the underground barrier pillar, and solidifying to plug the air leakage in the underground barrier pillar; and step 4, plugging the air leakage under a pressure: when the underground barrier pillar is deformed under the pressure, the plurality of fiber filaments and the upper fabric layer deforming as the underground barrier pillar is deformed and still covering the surface of the underground barrier pillar after the deforming to plug the air leakage in the underground barrier pillar because the plurality of fiber filaments and the upper fabric layer are flexible.

Further, in the step 3, the water is sprayed by a water mist nozzle with a spray angle of 120° at a spray pressure set to 6 MPa to 8 MPa and a water-spraying rate set to 5 L/m2 to 10 L/m2. Spraying water at these parameters can improve a solidification effect of the cement slurry flowing to the surface of the underground barrier pillar and flowing into the fractures of the underground barrier pillar, thereby ensuring a prominent plugging effect.

Compared with the prior art, the present disclosure has the following advantages.

1. The lower fabric layer of the present disclosure is made of a water-soluble material. In an on-site application, water is sprayed with an underground water pipe to the surface of the fire-prevention and extinguishing material for plugging the air leakage, such that the water enters the intermediate layer through the upper fabric layer and is mixed with the cement powder to produce the cement slurry, and in this case, the intermediate layer partially expands, so that the internal pressure of the intermediate layer is increased. As the water spraying continues, the water comes in contact with the lower fabric layer. Because the lower fabric layer can be decomposed by water, the cement slurry in the intermediate layer is released due to the internal pressure, and flows to fill into fractures in the coal rock and is solidified and formed in a short time, such that the fractures of the barrier pillar are completely plugged. In this way, the fire-prevention and extinguishing material for plugging the air leakage of the present disclosure can significantly reduce the air leakage of the fractures of the barrier pillar and effectively reduce the oxygen content of a goaf, thereby inhibiting the oxidation of the residual coal in the goaf.

2. The cement used in the present disclosure is a rapid-hardening cement that can be solidified in a short time. In on-site applications, after water is sprayed with an underground water pipe to the surface of the fire-prevention and extinguishing material for plugging the air leakage, due to the rapid setting performance of the rapid-hardening cement, the fire-prevention and extinguishing material for plugging the air leakage can be solidified in a short time to produce a cement wall. The cement wall can completely cover the barrier pillar to plug the air-leakage fractures and achieve the long-lasting plugging and complete coverage for fractures in a goaf.

3. The construction process for the fire-prevention and extinguishing material for plugging the air leakage of the present disclosure is simple. When used in a narrow underground space of a coal mine, the fire-prevention and extinguishing material for plugging the air leakage only needs to be rolled up and then transported to a construction site. During the construction process, the fire-prevention and extinguishing material for plugging the air leakage only needs to be fixed with anchor rods on a roof and a barrier pillar, and then water is sprayed with an underground water pipe evenly to the surface of the fire-prevention and extinguishing material for plugging the air leakage.

4. When the fire-prevention and extinguishing material for plugging the air leakage of the present disclosure is used to plug the air leakage, after water is sprayed, the rapid-hardening cement in the fire-prevention and extinguishing material for plugging the air leakage is first solidified to plug the air leakage in the barrier pillar. In this case, the fire-prevention and extinguishing material for plugging the air leakage has excellent compression resistance and deformation resistance in a direction perpendicular to the barrier pillar. Even if undergoing a mine pressure, a mine earthquake, or the like, the fire-prevention and extinguishing material for plugging the air leakage can still completely cover the air-leakage fractures of the barrier pillar to plug the air leakage and block off oxygen. In addition, because the fiber filaments and the upper fabric layer in the present disclosure are flexible, even if the solidified cement is damaged under the action of an external force such as a larger mine pressure, the fiber filaments and the upper fabric layer can deform as the barrier pillar is deformed, such that the fiber filaments and the upper fabric layer can still cover the surface of the barrier pillar after deformation to plug the air leakage in the barrier pillar. Through the multiple manners for plugging air leakage described above, the long-term fire prevention and extinguishing by plugging air leakage in a goaf can be finally achieved.

Figure 1:
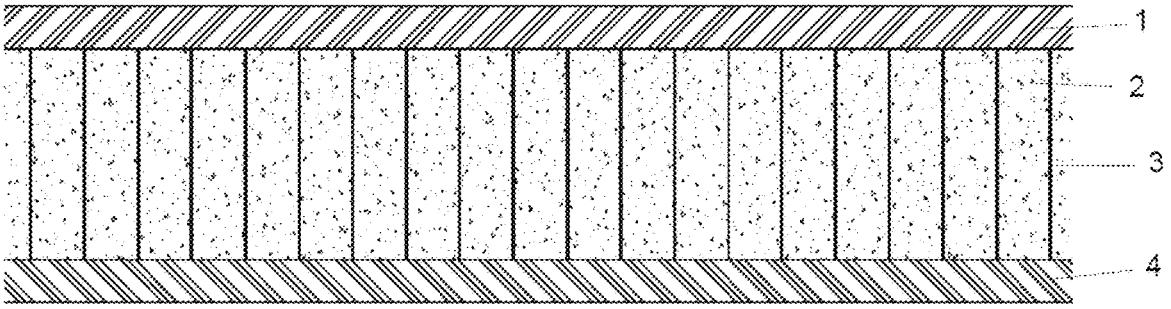
FIG. 1 is a schematic cross-sectional view of a fire-prevention and extinguishing material for plugging air leakage according to the present disclosure.

In the drawings: 1: upper fabric layer, 2: intermediate layer, 3: fiber filament, 4: lower fabric layer, 5: roadway roof, 6: top anchor rod, 7: fire-prevention and extinguishing material for plugging air leakage, 8: fixing anchor rod, and 9: barrier pillar.

DETAILED DESCRIPTION OF THE EMBODIMENTS

The present disclosure is further described below.

Example 1

A fire-prevention and extinguishing material for plugging an air leakage in an underground barrier pillar of a coal mine is provided, including an upper fabric layer 1, an intermediate layer 2, and a lower fabric layer 4, as shown in FIG. 1.

The intermediate layer 2 is arranged between the upper fabric layer 1 and the lower fabric layer 4. A plurality of fiber filaments 3 are evenly distributed in the intermediate layer 2. The plurality of fiber filaments 3 are nylon fiber filaments. Two ends of each of the plurality of fiber filaments 3 are connected to the upper fabric layer 1 and the lower fabric layer 4, respectively, such that the intermediate layer 2 has a flexible deformability. The intermediate layer 2 is filled with a rapid-hardening cement powder such that the rapid-hardening cement powder is evenly distributed around the plurality of fiber filaments 3.

The upper fabric layer 1 is made of aramid 1313. The upper fabric layer is configured to deform under a pressure to block off oxygen and plug the air leakage in the underground barrier pillar.

The lower fabric layer 4 is made of a water-soluble polyvinyl alcohol fiber. When in contact with water, the lower fabric layer is dissolved such that the cement powder in the intermediate layer 2 is mixed with the water to produce a cement slurry and the cement slurry is filled into fractures of the underground barrier pillar and solidified to plug the air leakage in the underground barrier pillar.

A preparation method of the fire-prevention and extinguishing material for plugging the air leakage in the underground barrier pillar of the coal mine is provided, specifically including the following steps. Respective materials were selected as needed, and the materials were woven into the upper fabric layer 1, the intermediate layer 2, and the lower fabric layer 4 by a textile technology. The plurality of fiber filaments 3 were evenly distributed in the intermediate layer 2. The intermediate layer 2 was filled with the cement powder such that the cement powder was evenly distributed around the plurality of fiber filaments 3. The intermediate layer 2 was sealed to obtain the fire-prevention and extinguishing material for plugging the air leakage in the underground barrier pillar of the coal mine. The size of the fire-prevention and extinguishing material for plugging the air leakage in Example 1 is as follows: a long side: 6,000 mm, a short side: 2,000 mm, and a thickness: 10 mm.

Example 2

This example is different from Example 1 only in that the upper fabric layer 1 is made of a phenolic fiber, and a size of the fire-prevention and extinguishing material for plugging the air leakage in Example 2 is as follows: a long side: 6,000 mm, a short side: 2,000 mm, and a thickness: 10 mm.

Example 3

This example is different from Example 1 only in that the upper fabric layer 1 is made of a polyimide fiber, and a size of the fire-prevention and extinguishing material for plugging the air leakage in Example 3 is as follows: a long side: 6,000 mm, a short side: 2,000 mm, and a thickness: 10 mm.

The fire-prevention and extinguishing materials for plugging the air leakage in Examples 1 to 3 each were tested as follows:

The fire-prevention and extinguishing materials for plugging the air leakage prepared in Examples 1 to 3 each were rolled from a short side into a roll along a long side, and an outer diameter of the roll was measured to determine the flexibility. Specific outer diameter test results and compressive strength data are shown in Table 1.

Figure 2:
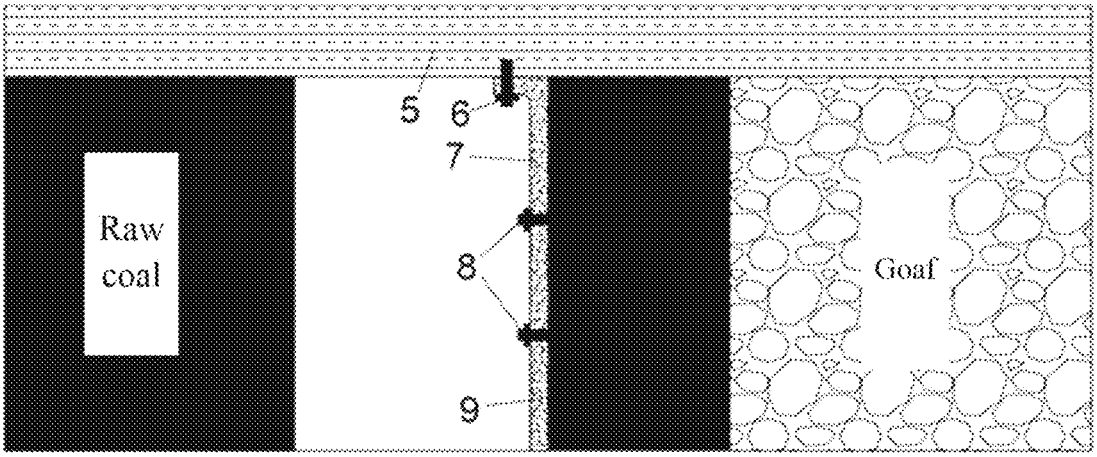
FIG. 2 is a schematic diagram of a specific implementation of a fire-prevention and extinguishing material for plugging air leakage according to the present disclosure.

Then the fire-prevention and extinguishing materials for plugging the air leakage prepared in Examples 1 to 3 each were laid out by the following use method. As shown in FIG. 2, the use method includes the following specific steps.

Step 1: Fixation of the fire-prevention and extinguishing material for plugging the air leakage to a roadway roof: In a roadway, the fire-prevention and extinguishing material for plugging the air leakage was laid from top to bottom along a surface of the barrier pillar 9 with the air leakage, and a top anchor rod 6 was arranged at a top of the fire-prevention and extinguishing material for plugging the air leakage to fix the fire-prevention and extinguishing material for plugging the air leakage to the roadway roof 5, where the lower fabric layer 4 faced towards the surface of the barrier pillar 9.

Step 2: Fixation of the fire-prevention and extinguishing material for plugging the air leakage to the barrier pillar: At two sides of the fire-prevention and extinguishing material for plugging the air leakage, fixing anchor rods 8 were arranged at intervals of 1.5 m to 2 m from the roadway roof 5 downwards, such that the fire-prevention and extinguishing material for plugging the air leakage was fixed to and pressed against the barrier pillar 9 and the lower fabric layer 4 was closely attached to the surface of the barrier pillar 9.

Step 3: Water spraying for plugging the air leakage: Water was sprayed with an underground water pipe evenly to the upper fabric layer 1 of the fire-prevention and extinguishing material for plugging the air leakage 7, and the water entered the intermediate layer 2 through the upper fabric layer 1 and was mixed with the cement powder to produce the cement slurry. As the water spraying continued, the water came in contact with the lower fabric layer 4 to dissolve the lower fabric layer 4, and then the cement slurry in the intermediate layer 2 flowed from the dissolved lower fabric layer 4 to the surface of the barrier pillar 9, flowed into the fractures of the barrier pillar 9, and was solidified to plug the air leakage in the barrier pillar 9. The water was sprayed by a water mist nozzle with a spray angle of 120° at a spray pressure set to 6 MPa to 8 MPa and a water-spraying rate set to 5 L/m2 to 10 L/m2. Spraying water at these parameters can improve a solidification effect of the cement slurry flowing to the surface of the barrier pillar 9 and flowing into the fractures of the barrier pillar, thereby ensuring a prominent plugging effect.

Step 4: Plugging of the air leakage under a pressure: when the barrier pillar 9 was deformed under the pressure, the fiber filaments 3 and the upper fabric layer 1 deformed as the barrier pillar 9 was deformed and still covered the surface of the barrier pillar 9 after the deformation to plug the air leakage in the barrier pillar 9 because the fiber filaments 3 and the upper fabric layer 1 were flexible.

After the layout was completed, on day 1, day 3, and day 28, the fire-prevention and extinguishing materials for plugging the air leakage prepared in Examples 1 to 3 each were cut into a strip structure of 10 mm×10 mm×500 mm and then tested for a flexural strength by an electric cement bending testing machine. Specific data is shown in Table 1.

TABLE 1

Test data of the fire-prevention and extinguishing materials for plugging the air leakage prepared in Examples 1 to 3

| Example | Outer diameter/mm | Flexural strength/MPa | | |
|---|---|---|---|---|
| | | 1 d | 3 d | 28 d |
| 1 | 289 | 1.0 | 5.6 | 9.2 |
| 2 | 289 | 0.9 | 5.1 | 8.9 |
| 3 | 292 | 1.3 | 5.7 | 9.3 |

It can be seen from Table 1 that the fire-prevention and extinguishing material for plugging the air leakage in the underground barrier pillar of the coal mine of the present disclosure has excellent flexibility. Ideally, when a completely-flexible fabric has a length 1 and a thickness s and a roll of the fabric rolled from a short side along a long side has an inner diameter d=0 and an outer diameter D, these parameters should satisfy the following equation I□ $S=\pi(D^2-d^2)/4$. The fire-prevention and extinguishing materials for plugging the air leakage prepared in Examples 1 to 3 each have a length of 6,000 mm and a thickness of 10 mm. Ideally, rolls rolled from the fire-prevention and extinguishing materials for plugging the air leakage prepared in Examples 1 to 3 should have an outer diameter of 276 mm. According to actual measurements, the rolls rolled from the fire-prevention and extinguishing materials for plugging the air leakage in Examples 1 to 3 have an outer diameter merely of 289 mm to 292 mm that is merely 5% higher than the ideal value, indicating very excellent flexibility. This is mainly because fabric materials are adopted at a top and a bottom of the fire-prevention and extinguishing material for plugging the air leakage, which greatly increases the flexibility of the fire-prevention and extinguishing material for plugging the air leakage. In addition, the fire-prevention and extinguishing material for plugging the air leakage has a thickness merely of 10 mm, and the fiber filaments 3 are added to the intermediate layer 2, such that the flexibility of the fire-prevention and extinguishing material for plugging the air leakage can be significantly improved. Thus, when in use, the fire-prevention and extinguishing material for plugging the air leakage only needs to be rolled up and then transported to a construction site.

It can also be seen from Table 1 that the fire-prevention and extinguishing material for plugging the air leakage in the underground barrier pillar of the coal mine prepared in each of Examples 1 to 3 has a prominent flexural strength, where flexural strengths on day 1, day 3, and day 28 reach 0.9 MPa to 1.3 MPa, 5.1 MPa to 5.7 MPa, and 8.9 MPa to 9.3 MPa, respectively. The fire-prevention and extinguishing material for plugging the air leakage of the present disclosure adopts a rapid-hardening cement, and the rapid-hardening cement can be quickly solidified after being in contact with water. In addition, because each fiber filament is tightly connected to the upper and lower fabric layers, after being sprayed with water and solidified, the fire-prevention and extinguishing material for plugging the air leakage has excellent compression resistance and deformation resistance in a direction perpendicular to the barrier pillar. Even if undergoing a mine pressure, a mine earthquake, or the like, the fire-prevention and extinguishing material for plugging the air leakage can still completely cover air-leakage fractures of the barrier pillar to plug the air leakage and block off oxygen.

The fire-prevention and extinguishing material for plugging the air leakage of the present disclosure can be solidified close to the barrier pillar in a short time to produce a protective layer for plugging air leakage, and the protective layer completely covers the barrier pillar 9 to plug the air-leakage fractures and reduce the air leakage, thereby achieving the long-lasting prevention and control of spontaneous combustion of coal by plugging the air leakage and blocking off oxygen in the adjacent goaf.

The above are merely preferred implementations of the present disclosure. It should be noted that a person of ordinary skill in the art may further make several improvements and modifications without departing from the principle of the present disclosure, but such improvements and modifications should be deemed as falling within the protection scope of the present disclosure.

The invention claimed is:

1. A use method of a fire-prevention and extinguishing material for plugging an air leakage in an underground barrier coal pillar of a coal mine, wherein the fire-prevention and extinguishing material for plugging the air leakage has a layered structure and comprises an upper fabric layer, an intermediate layer, and a lower fabric layer; the intermediate layer is arranged between the upper fabric layer and the lower fabric layer; a plurality of fiber filaments are arranged in the intermediate layer, and the plurality of fiber filaments are evenly distributed in the intermediate layer, and two ends of each of the plurality of fiber filaments are connected to the upper fabric layer and the lower fabric layer, respectively, such that the intermediate layer has a flexible deformability; the intermediate layer is filled with a cement powder such that the cement powder is evenly distributed around the plurality of fiber filaments; the upper fabric layer is made of a flame-retardant flexible material, and the upper fabric layer is configured to deform under a pressure to block off oxygen and plug the air leakage in the underground barrier coal pillar; the lower fabric layer is made of a water-soluble polyvinyl alcohol fiber, and when in contact with water, the lower fabric layer is dissolved such that the cement powder in the intermediate layer is mixed with the water to produce a cement slurry and the cement slurry is filled into fractures of the underground barrier coal pillar and solidified to plug the air leakage in the underground barrier coal pillar; and the use method comprises following steps:

step 1, fixing to a roadway roof: in a roadway, laying the fire-prevention and extinguishing material for plugging the air leakage from top to bottom along a surface of the underground barrier coal pillar with air leakage, and arranging a top anchor rod at a top of the fire-prevention and extinguishing material for plugging the air leakage to fix the fire-prevention and extinguishing material for plugging the air leakage to the roadway roof, wherein the lower fabric layer faces towards the surface of the underground barrier coal pillar;

step 2, fixing to the underground barrier coal pillar: at two sides of the fire-prevention and extinguishing material for plugging the air leakage, arranging fixing anchor rods at intervals of 1.5 m to 2 m from the roadway roof downwards, such that the fire-prevention and extinguishing material for plugging the air leakage is fixed to and pressed against the underground barrier coal pillar and the lower fabric layer is closely attached to the surface of the underground barrier coal pillar;

step 3, spraying water for plugging the air leakage: spraying water with an underground water pipe evenly to the upper fabric layer of the fire-prevention and extinguishing material for plugging the air leakage, the water entering the intermediate layer through the upper fabric layer and mixing with the cement powder to produce the cement slurry, and continuing spraying water, the water coming in contact with the lower fabric layer to dissolve the lower fabric layer, and then the cement slurry in the intermediate layer flowing from the dissolved lower fabric layer to the surface of the underground barrier coal pillar, flowing into the fractures of the underground barrier coal pillar, and solidifying to plug the air leakage in the underground barrier coal pillar; and step 4, plugging the air leakage under a pressure: when the underground barrier coal pillar is deformed under the pressure, the plurality of fiber filaments and the upper fabric layer deforming as the underground barrier coal pillar is deformed and still covering the surface of the underground barrier coal pillar after the deforming to plug the air leakage in the underground barrier coal pillar because the plurality of fiber filaments and the upper fabric layer are flexible.

2. The use method of the fire-prevention and extinguishing material for plugging the air leakage in the underground barrier coal pillar of the coal mine according to claim 1, further comprising that in the step 3, the water is sprayed by a water mist nozzle with a spray angle of 120° at a spray pressure set to 6 MPa to 8 MPa and a water-spraying rate set to 5 L/m? to 10 L/m?.

3. The use method of the fire-prevention and extinguishing material for plugging the air leakage in the underground barrier coal pillar of the coal mine according to claim 1, further comprising that the upper fabric layer is made of one selected from the group consisting of aramid 1313, a polyphenylene sulfide fiber, a phenolic fiber, a melamine fiber, and a polyimide fiber, or a mixture of two or more thereof.

4. The use method of the fire-prevention and extinguishing material for plugging the air leakage in the underground barrier coal pillar of the coal mine according to claim 1, further comprising that the plurality of fiber filaments are nylon fiber filaments.

5. The use method of the fire-prevention and extinguishing material for plugging the air leakage in the underground barrier coal pillar of the coal mine according to claim 1, further comprising that the cement powder is a rapid-hardening cement powder.

* * * * *